US005248453A

United States Patent [19]

Ramm

[11] Patent Number: 5,248,453

[45] Date of Patent: Sep. 28, 1993

[54] PROCESSING OF A DRY PRECURSOR MATERIAL

[75] Inventor: Eric J. Ramm, Sydney, Australia

[73] Assignee: Australian Nuclear Science & Technology Organization, Lucas Heights, Australia

[21] Appl. No.: 700,143

[22] PCT Filed: Nov. 17, 1989

[86] PCT No.: PCT/AU89/00500

§ 371 Date: Jul. 18, 1991

§ 102(e) Date: Jul. 18, 1991

[87] PCT Pub. No.: WO90/05984

PCT Pub. Date: May 31, 1990

[30] Foreign Application Priority Data

Nov. 18, 1988 [AU] Australia ..... PJ1556

[51] Int. Cl.[5] ..... G21F 9/16

[52] U.S. Cl. ..... 252/629; 252/632; 250/506.1

[58] Field of Search ..... 252/626, 630, 629-632, 252/633; 588/251, 252; 250/506.1

[56] References Cited

U.S. PATENT DOCUMENTS

| | | | |
|---|---|---|---|
| 4,409,029 | 10/1983 | Larker et al. | 419/10 |
| 4,626,414 | 12/1986 | Baatz et al. | 422/159 |
| 4,642,204 | 2/1987 | Burstrom et al. | 252/633 |
| 4,645,624 | 2/1987 | Ramm et al. | 252/628 |
| 4,675,129 | 6/1987 | Baatz et al. | 252/633 |
| 4,778,626 | 10/1988 | Ramm et al. | 252/628 |
| 4,808,337 | 2/1989 | Ramm et al. | 252/628 |
| 4,834,917 | 5/1989 | Ramm et al. | 252/633 |

*Primary Examiner*—Peter A. Nelson
*Assistant Examiner*—Ngoclan T. Mai
*Attorney, Agent, or Firm*—Townsend and Townsend Khourie and Crew

[57] ABSTRACT

A container (13) is arranged to be filled with a dry precursor material and the top of the container is welded shut. The container (13) has a generally cylindrical shape with at least a partially corrugated side wall (23). The top of the container (27) has a filling port (21) and a plug (22) adapted to fit therein. A cylindrical liner (24) fits snugly within the container (13) and extends between an inlet and outlet filter (25) and (26) located at the bottom (20) and top (27) of the container, respectively. At the center of the top of the container (27), a gas outlet (28) is provided, the gas outlet (28) in the form of a vertical extending pipe which passes through the plug (22) and terminates in a transverse perforated pipe (29) at its lower end. The perforated pipe (29) is separated from the dry precursor material within the container (13) by the outlet filter (26). At the bottom of the container (20), a gas inlet (30) is provided in one side wall of the container. Inside the container (13) the pipe (30) extends horizontally parallel to the bottom of the container (20). It is also perforated and is separated from the dry precursor material by the inlet filter (25). The container (13) is heated in either a batch or continuous process while a reducing gas such as hydrogen or nitrogen is introduced at the gas inlet (30). This gas passes from the perforated pipe (31) and eventually passes through the outlet pipe (28). The container (13) is heated for a time sufficient to ensure that substantially all the nitrates within the dry precursor material have been decomposed and removed.

33 Claims, 4 Drawing Sheets

PROCESSING OF A DRY PRECURSOR MATERIAL

TECHNICAL FIELD

The present invention relates to a method of processing a dry precursor material incorporating radioactive waste. The invention is particularly concerned with the incorporation of high level radioactive waste within an immobilising substance such as synthetic rock or glass.

BACKGROUND OF THE INVENTION

An existing arrangement for producing synthetic rock precursor incorporating high level radioactive waste involves the production of synthetic rock precursor using tetraisopropyltitanate and tetrabutylzirconate as ultimate sources of titanium oxide $TiO_2$ and $ZrO_2$. The components are mixed with nitrate solutions of other components, coprecipitated by addition of sodium hydroxide and then washed. The precursor thus produced is mixed in a hot cell with high level nuclear waste in the form of a nitrate solution to form a thick homogenous slurry. The slurry is then fed to a rotary kiln in which the slurry is heated, devolatilized and calcined to produce a powder which is then mixed with metallic titanium powder and poured into containers for hot pressing.

The containers which are used for this purpose have a generally cylindrical wall of bellows-like formation. Heat and pressure is applied to each container and its contents, and a synthetic rock product is formed within the container with the high level radioactive waste suitably immobilised therein.

A system for producing synthetic rock as described above has a number of deficiencies which will now be outlined.

The apparatus required to produce the synthetic rock requires that a slurry incorporating high level radioactive waste be fed into a calciner. The calciner must be free of oxygen by the use of a reducing gas and at the same time the slurry must be heated and dried.

A calciner which meets all these objectives is a large and cumbersome apparatus with numerous working parts on which it is difficult to perform maintenance on. Typically, a rabble bar is required within the calciner to prevent caking of the slurry and a filtration system is required to prevent escape of radioactive dust.

The present invention provides an alternative method for use in forming a substance incorporating immobilised radioactive waste.

DISCLOSURE OF THE INVENTION

According to the present invention, there is provided a method of processing a dry precursor material incorporating radioactive waste comprising: filling a container with dry precursor material incorporating radioactive waste and nitrate components, the container having a generally cylindrical shape with at least a partially corrugated side wall, a gas outlet, an outlet filter, a gas inlet and an inlet filter; sealing the container excepting the gas inlet and outlet; heating the container and its contents while feeding a gas through the gas inlet, inlet filter and dry precursor material; and collecting exhaust gas passing through the outlet filter and gas outlet; whereby a dry calcined material incorporating radioactive waste is produced in a form in which substantially all nitrate components have been decomposed and removed.

Preferably deleterious effects of the dried calcined material when in the form of a synthetic rock precursor are avoided by providing that the gas is a reducing gas such as $H_2$.

Preferably, the method includes a step of hot isostatically or uniaxially pressing the container once substantially all the nitrate components have been decomposed and removed.

The gas inlet and outlet are preferably arranged at opposite ends of the container.

Alternatively, the gas inlet and outlet may be located on the side wall of the container or at the same end.

The gas inlet and outlet may both be connected with a perforated inlet and outlet pipe respectively which are located within the container and are separated from the dry precursor material by the inlet and outlet filters respectively.

Preferably, the container has a dumb-bell shape.

The container is preferably provided with a filling port which is arranged to permit filling of the container with dry precursor material.

It is preferred that a step be provided for inserting a plug in the filling port after the container has been filled with dry precursor material.

Preferably, the plug incorporates the gas outlet.

The plug may be welded in position to provide a seal which prevents escape of material from within the container.

Preferably, the inlet and outlet filters are disc-like in shape and are located at the base and top of the container respectively.

Preferably, the gas filters have a diameter substantially the same as the maximum diameter of the container.

It is preferred that the container be provided with a cylindrical liner to prevent dry precursor material from locating itself within the corrugations of the container.

The container may also be provided with a heat transfer and stabilising plate.

The inlet and outlet filter preferably comprise a perforated shroud.

The inlet and outlet filter may be formed from a ceramic fibre such as zirconium oxide which is substantially only pervious to gas.

According to one embodiment of the present invention, the gas which is introduced through the gas inlet is a reducing gas such as hydrogen or nitrogen with three percent by volume hydrogen.

A back pressure may be provided at the gas outlet to reduce problems associated with channelling in the container.

Preferably, the exhaust gas is fed through a water reservoir which provides the back pressure.

The present invention also provides a method of producing a dry calcined material incorporating radioactive waste, comprising:

mixing radioactive waste with a particulate material and applying heat thereto to form a dry precursor material impregnated with radioactive waste;

feeding the dry precursor material into a container having a generally cylindrical shape with at least a partially corrugated side wall, a gas outlet, an outlet filter, a gas inlet and inlet filter;

sealing the container excepting the gas inlet or outlet;

heating the container and its contents while feeding gas through the gas inlet, inlet filter and dry precursor material, collecting exhaust gas passing through the outlet filter and gas outlet; and producing a dry calcined material incorporating radioactive waste in which substantially all nitrate components have been decomposed and removed.

Preferably, the dry precursor material is mixed and heated in a heating chamber having a screw discharge means.

A volumetric feeder may be used to feed the particulate material into the heating chamber.

The radioactive waste may be sprayed onto the particulate material in the heating chamber.

Preferably, the dry precursor material is mixed in the heating chamber by a mixer rotatable about a horizontal axis.

The heating chamber may be connected with a discharge hopper comprising a vertical screw conveyor for feeding the dry precursor material into a container.

Preferably, a plurality of containers are filled with dry precursor material and are processed by the method previously described in a batch or in a continuous feeding system.

In one embodiment each gas inlet is crimped and each container is evacuated once the plurality of containers have been processed by the method previously described. The gas outlet is then crimped to provide a gas tight container.

The dry precursor material can be converted to a stable inorganic solid such as glass, glass ceramic, ceramic, or synthetic rock.

Preferably, the invention has the advantage of substantially reducing loss of volatile radioactive components.

Additionally, it is preferred that the invention has the advantage of substantially reducing the loss of dust from the container.

Advantageously, the present invention eliminates the need apparatus such as a rotary calciner and therefore avoids problems associated with moving parts and wet and dry seals.

DESCRIPTION OF THE DRAWINGS

An embodiment of the present invention will now be described by way of example only with reference to the accompanying drawings in which.

BEST MODE OF CARRYING OUT THE INVENTION

Figure 1:
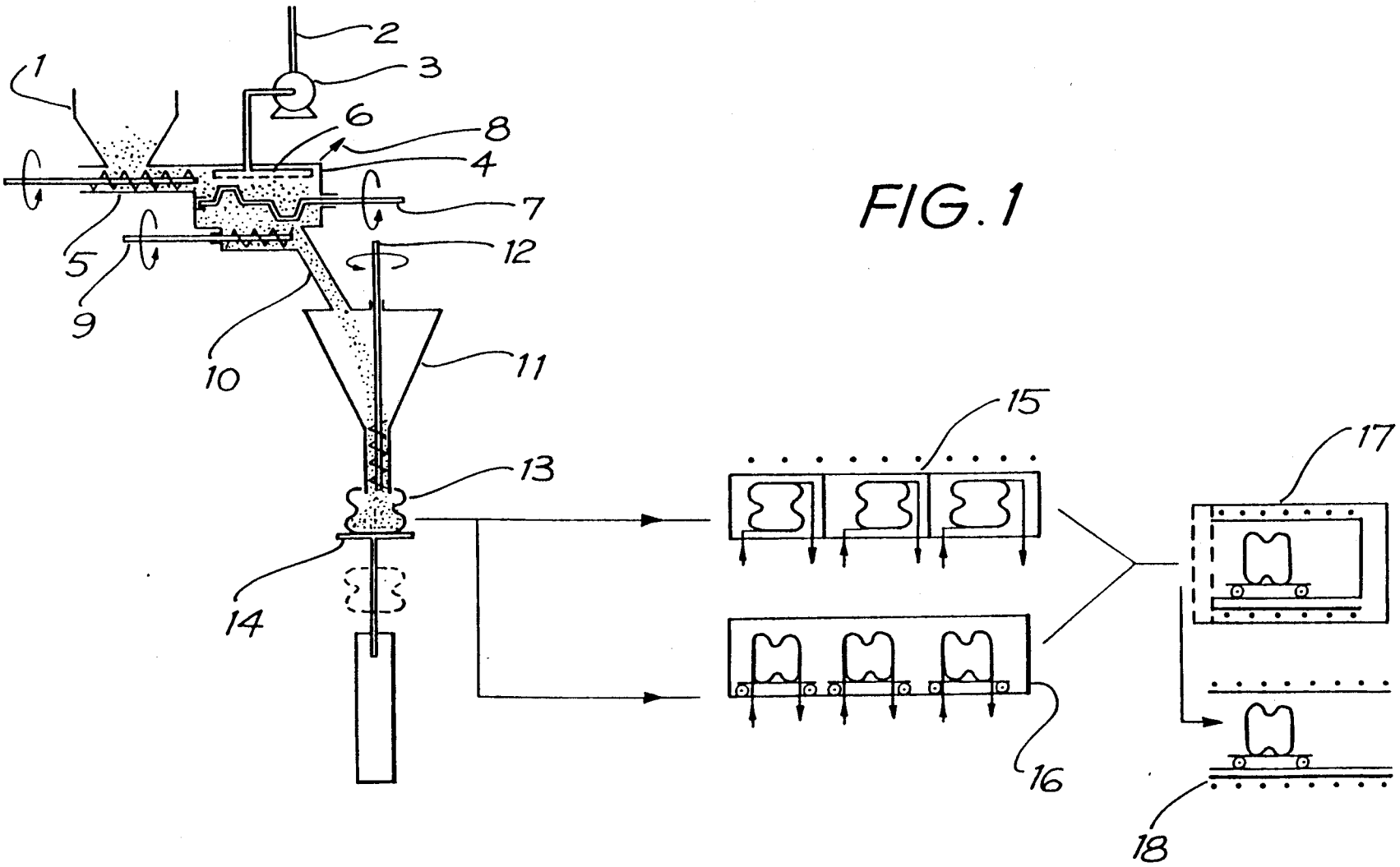
FIG. 1 shows a method of producing a synthetic rock precursor material impregnated with radioactive waste.

A method of producing a synthetic rock precursor material impregnated with radioactive waste will now be described with reference to FIG. 1.

Particulate material in the form of a dry granulated powder in a hopper 1 is fed to a heating chamber 4 by means of a volumetric feeder 5. High level radioactive waste is fed by means of a conduit 2 through a metering pump 3 and is sprayed onto the particulate material within the heating chamber 4 by means of perforated tubing 6.

High level radioactive waste is mixed with the particulate material in the heating chamber 4 and gases which evolve during heating are removed therefrom by means of an off gas pipe 8.

The particulate material incorporating high level radioactive waste is removed from the heating chamber 4 by means of a screw discharge conveyor 9. At this stage, it is in the form of a dry precursor material.

The screw discharge conveyor feeds the dry precursor material into a conduit where it falls under the action of gravity into a hopper 11. A vertical screw discharge conveyor located in the hopper 11 is used to transfer the dry calcined material into respective containers at the bottom of the hopper 11.

Each container 13 is supported on a vertically movable table which enables a container which has been filled with dry precursor material to be lowered so that a lid can be welded on top of it to provide an air tight seal excepting for a gas inlet and outlet.

Once each container has been filled and welded shut, it may be processed in either a batch 15 or as part of a continuous feeding system 16 in a manner which will be described later.

Each container once it has been processed is then evacuated by first crimping the inlet and then using a suction device to remove any gas. The container is then completely sealed by crimping the outlet and is then transferred to a furnace 17 for hot isostatic or uniaxial pressing whereby the dry precursor material is transformed into a synthetic rock in which the high level radioactive waste is immobilized therein. The container is then removed from the furnace 17 and is conveyed through a continuous cooling chamber 18.

The containers used in the method described with reference to FIG. 1 will now be described in more detail. The containers may be as shown either in FIG. 2 or FIG. 3.

Figure 2:
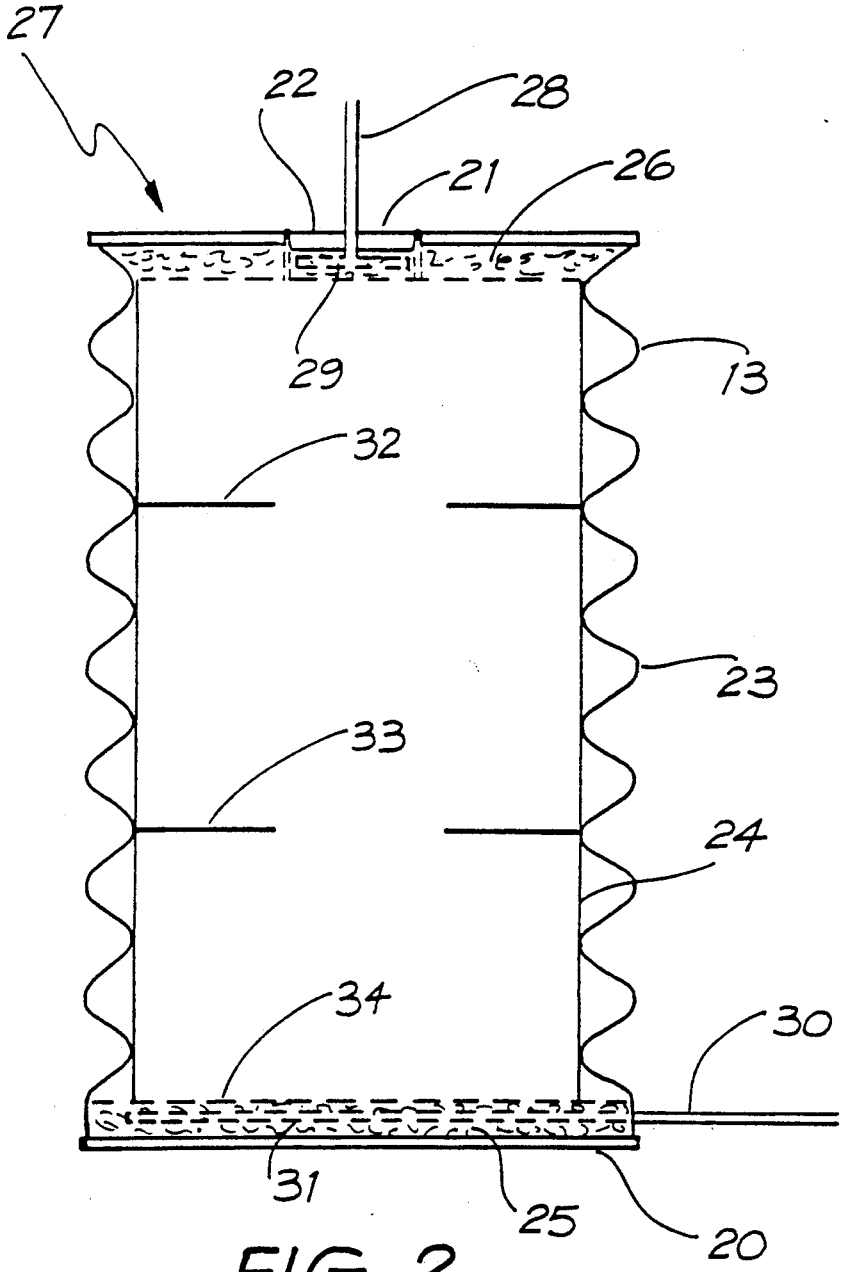
FIG. 2 shows a bellows container for the process shown in FIG. 1.

Effectively, the container is a cylinder in FIG. 2 having a corrugated side wall 23. The top of the container 27 has a filling port 21 and a plug 22 adapted to fit therein.

A cylindrical liner 24 fits snugly within the container 13 and extends between an inlet and outlet filter 25 and 26 which are located at the bottom 20 and top 27 of the container respectively.

Both the inlet and outlet filter are effectively disc like in shape and are formed from a ceramic fibre material such as zirconium oxide or titanium oxide fibre.

At the centre of the top of the container 27, a gas outlet is provided 28. The gas outlet 28 is in the form of a vertically extending pipe which passes through the plug 22 and terminates in a transverse perforated pipe 29 at its lower end. The perforated pipe 29 is separated from the dry precursor material within the container by the outlet filter 26.

At the bottom of the container, a gas inlet 30 is provided in one side wall of the container. Inside the container the pipe 30 extends horizontally, parallel to the bottom of the container. It is also perforated and is separated from the dry precursor material by the inlet filter 25.

Within the liner 24 heat transfer stabilising plates 32 and 33 are provided which divide the container into three distinct chambers. The heat transfer and stabilising plates help prevent deformation of the container during hot uniaxial pressing of the container and in addition provide a means of assisting heat transfer within the container.

A perforated shroud 34 may also be provided as a containment structure for the inlet filter.

Figure 3:
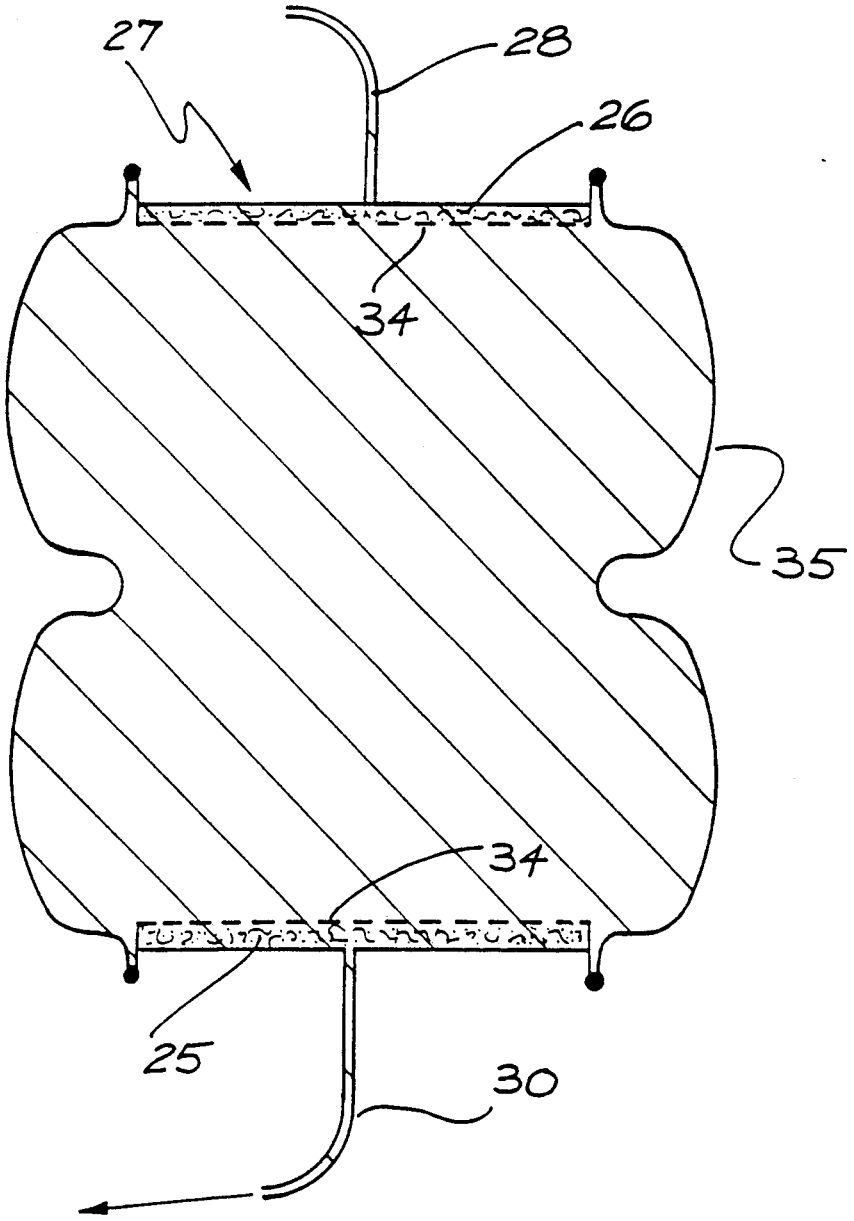
FIG. 3 shows a dumbell container for the process shown in FIG. 1.

In FIG. 3 an alternative construction of the container 13 is shown in which a dumb-bell shape 35 is utilised. Effectively, the components of this type of container are the same as that shown in FIG. 2, however, the liner 24 and heat transfer and stabilising plates are not required.

With regard to the actual method of processing a dry precursor material to make as synthetic rock within a container shown in FIG. 2 or FIG. 3, a container is heated in either a batch or a continuous process while a reducing gas such as hydrogen or nitrogen with three percent by volume hydrogen is introduced at the gas inlet 30. This gas passes from the perforated pipe 31 through the inlet filter 35, through the dry precursor material, through the outlet filter 26 and out through the outlet pipe 29 and 28.

A hack pressure is provided at the outlet pipe 28 by feeding the exhaust gas passing through the outlet pipe 28 into a reservoir filled with water. The back pressure ensures that the reducing gas is evenly distributed through the dry precursor material as it passes through the container, and this reduces channelling.

The container is heated to a temperature such as 750° C. for a time sufficient to ensure the substantially all the nitrates within the dry precursor material have been decomposed and removed. Thus a calcination process is effectively carried out within the container.

The advantages of the embodiment described above are outlined as follows:

Firstly because the calcination process takes place within the container rather than within a large volume calciner, the costs associated with producing a synthetic rock incorporating radioactive waste are significantly reduced.

In addition because a large rotary calciner is eliminated from the process, associated difficulties in retaining gas tight seals and maintenance of mechanical components are also significantly reduced.

Further, a titanium metal addition stage after calcination is eliminated and the loss of volatile components during calcination is also reduced.

An embodiment of the present invention will now be described with reference to FIG. 4 which shows a method of using a dry precursor material to produce a glass incorporating high level radioactive waste.

Figure 4:
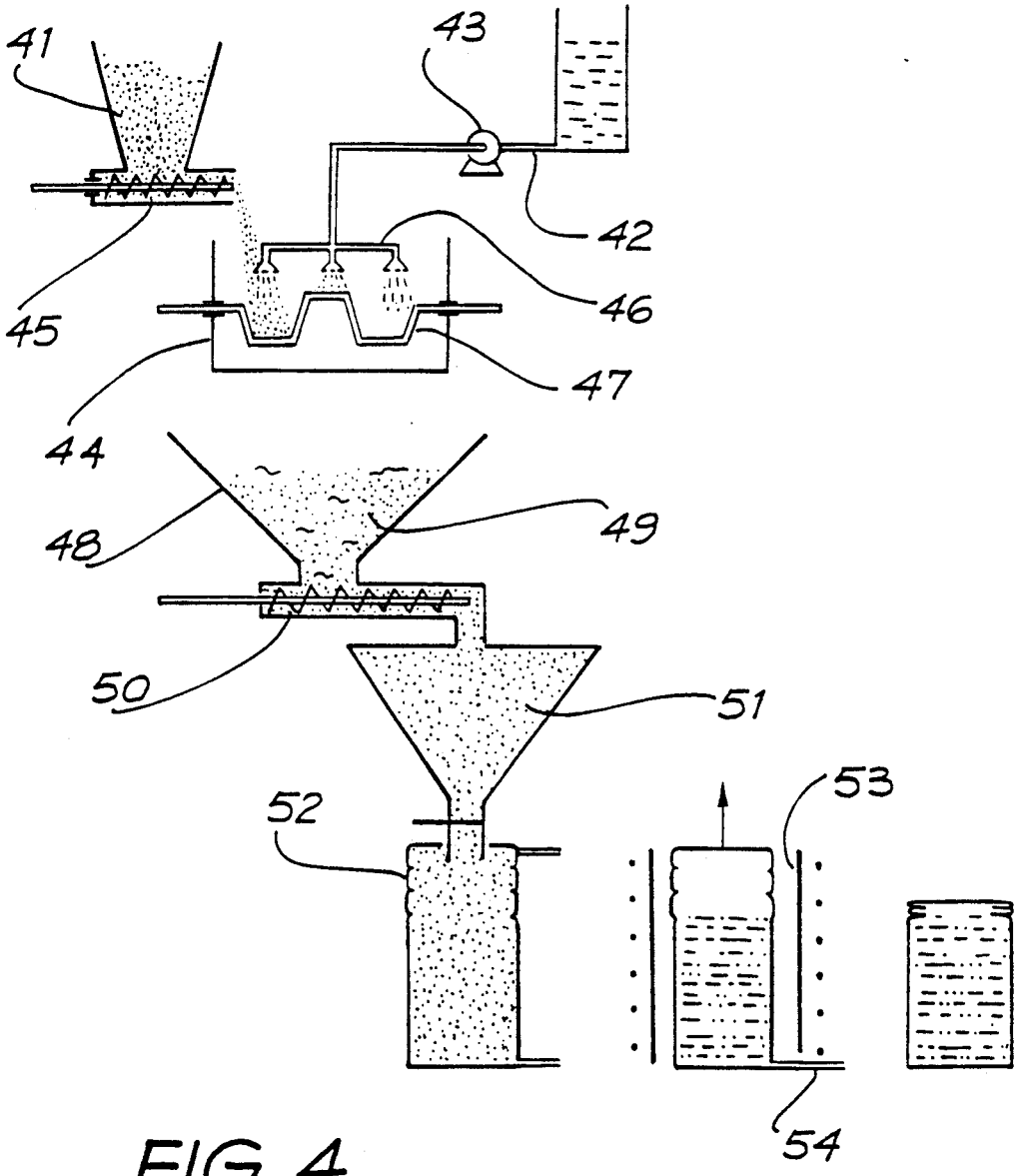
FIG. 4 shows a method of producing glass impregnated with radioactive waste.

In essence the method shown in FIG. 4 is similar to that shown in FIG. 1 although there are slight modifications due to the differences in process requirements between glass and synthetic rock.

Glass forming powder is fed into a hopper 41 and by means of a volumetric feeder 45 is fed into a heating chamber 44. High level radioactive waste is fed by means of a conduit 42 from a storage container through a metering pump 43 and is sprayed onto glass forming powder within the heating chamber 44 by means of a sprinkler system 46. Within the heating chamber, high level radioactive waste is mixed and heated with the glass forming powder. The mixing is performed by a mixer which is rotatable about a horizontal axis.

Gases which are evolved by the heating process within the heating chamber 44 are removed from the heating chamber by means of an off gas pipe (not shown).

The glass forming powder incorporating high level radioactive waste is discharged into a hopper 48 and is then fed by means of a volumetric feeder 50 to a discharge hopper 51.

A container 52 below the hopper 51 is then filled with glass forming powder and may then be welded shut in the same manner as described in the process of FIG. 1.

A comparison of the shape of the container 52 shown in FIG. 4 and that shown in FIGS. 1 to 3 highlights that it is not necessary to have the side wall of the container provided with corrugations from top to bottom.

The actual method of processing the glass forming powder within the container 52 is essentially the same as that used to process the synthetic rock precursor material within the containers shown in FIGS. 2 or 3. One major difference however is that air or inert gas may be fed into the inlet 54 (inlet 30 of FIG. 2) rather than a reducing gas. This is because of the different chemical properties of glass forming powder. .

Another difference is that during the heating of the container 52 within the furnace 53, nitrates are decomposed and removed after heating to approximately 750° C. On further heating from 1100° to 1300° C., the powder mixture is vitrified. The result is that glass which forms within the container 52 occupies less volume than the glass forming powder.

Thus space exists at the top of the container and this space corresponds with the part of the container which has a corrugated side wall if a container with a partially corrugated side wall is utilised.

Once the container is removed from the furnace 53 the top of the container can be compressed by any suitable compressing means and the resultant product is glass having high level radioactive waste immobolised therein.

I claim:

1. A method of processing dry precursor material incorporating radioactive waste comprising: filling a container with dry precursor material incorporating radioactive waste and nitrate components, the container having a generally cylindrical shape with at least a partially corrugated side wall, a gas outlet, an outlet filter, a gas inlet and an inlet filter; sealing the container excepting the gas inlet and outlet; heating the container and its contents while feeding a gas through the gas inlet, inlet filter and dry precursor material; and collecting exhaust gas passing through the outlet filter and gas outlet; whereby a dry calcined material incorporating radioactive waste is produced in a form in which substantially all nitrate components have been decomposed and removed.

2. A method according to claim 1, wherein deleterious effects of the dried calcined material when in the form of a synthetic rock precursor are avoided by providing that the gas is a reducing gas.

3. A method according to claim 1 or 2, wherein the method includes a step of hot isostatically or uniaxially pressing the container once substantially all the nitrate components have been decomposed and removed.

4. A method according to claim 1, wherein the gas outlet and inlet are arranged at opposite ends of the container.

5. A method according to claim 1, wherein the gas inlet and outlet are located on the side wall of the container or at the same end.

6. A method according to claim 4, wherein the gas inlet and outlet are both arranged to be connected with a perforated inlet and outlet pipe respectively which are located within the container and are separated from the dry precursor material by the inlet and outlet filters respectively.

7. A method according to claim 6, wherein the container has a dumb-bell shape.

8. A method according to claim 1, wherein the dry precursor material is glass powder.

9. A method of processing a dry precursor material incorporating radioactive waste comprising: filling a container with dry precursor material incorporating radioactive waste and nitrate components, the container having a generally cylindrical shape with at least a partially corrugated side wall, a gas outlet, an outlet filter, a gas inlet and an inlet filter; sealing the container excepting the gas inlet and outlet; heating the container and its contents while feeding a reducing gas through the gas inlet, inlet filter and dry precursor material; and collecting exhaust gas passing through the outlet filter and gas outlet; whereby a dry calcined material incorporating radioactive waste is produced in a form in which deleterious effects have been substantially avoided and substantially all nitrate components have been decomposed and removed.

10. A method according to claim 9, including a step of hot isostatically or uniaxially pressing the container once substantially all the nitrate components have been decomposed and removed.

11. A method according to claim 10, wherein the gas inlet and outlet are arranged at opposite ends of the container.

12. A method according to claim 11, wherein the gas inlet and outlet are both connected with a perforated inlet and outlet pipe respectively which are located within the container and are separated from the dry precursor material by the inlet and outlet filters respectively.

13. A method according to claim 12, wherein the container has a dumb-bell shape.

14. A method according to claim 9, wherein the container is provided with a filling port which is arranged to permit filling of the container with dry precursor material and a step is provided for inserting a plug in the filling port after the container has been filled with dry synthetic rock precursor material.

15. A method according to claim 14, wherein the plug incorporates the gas outlet.

16. A method according to claim 15, wherein the gas filters are disc-like in shape and are located at the base and top of the container respectively and have a diameter substantially the same as the maximum diameter of the container.

17. A method according to claim 16, wherein the container is provided with a cylindrical liner to prevent dry precursor material from locating itself within the corrugations of the container.

18. A method according to claim 9, wherein the container is provided with a heat transfer and stabilising plate.

19. A method according to claim 18, wherein the inlet and outlet filter preferably comprise a perforated shroud.

20. A method according to claim 19, wherein the inlet and outlet filter are formed from a ceramic fibre such as zirconium oxide which is substantially only pervious to gas.

21. A method according to claim 20, wherein the gas which is introduced through the gas inlet is nitrogen with three percent by volume hydrogen.

22. A method according to claim 9, wherein a back pressure is provided at the gas outlet to reduce problems associated with channelling in the container.

23. A method according to claim 22, wherein the exhaust gas is fed through a water reservoir which provides the back pressure.

24. A method of producing a dry calcined material incorporating radioactive waste, comprising:

mixing radioactive waste with a particulate material and applying heat thereto to form a dry precursor material impregnated with radioactive waste and incorporating nitrate components;

feeding the dry precursor material into a container having a generally cylindrical shape with at least a partially corrugated side wall, a gas outlet, an outlet filter, a gas inlet and inlet filter;

sealing the container excepting the gas inlet and outlet;

heating the container and its contents while feeding gas through the gas inlet, inlet filter and dry precursor material, collecting exhaust gas passing through the outlet filter and gas outlet; and producing a dry calcined material incorporating radioactive waste in which substantially all nitrate components have been decomposed and removed.

25. A method according to claim 24, wherein the dry precursor material is mixed and heated in a heating chamber having a screw discharge means.

26. A method according to claim 25, wherein a volumetric feeder is used to feed the particulate material into the heating chamber.

27. A method according to claim 26, wherein the radioactive waste is sprayed onto the particulate material in the heating chamber.

28. A method according to claim 27, wherein the dry precursor material is mixed in the heating chamber by a mixer rotatable about a horizontal axis.

29. A method according to claim 25, wherein the heating chamber is connected with a discharge hopper comprising a vertical screw conveyor for feeding the dry precursor material into a container.

30. A method according to claim 24, wherein a plurality of containers containing dry calcined material incorporating radioactive waste in which substantially all nitrate components have been decomposed and removed, are processed in a continuous feeding system.

31. A method according to claim 30, wherein each gas inlet of each container is crimped and is evacuated once it has been processed to produce a dry calcined material.

32. A method of processing dry precursor material incorporating radioactive waste comprising: filling a container with glass forming powder incorporating radioactive waste and nitrate components, the container having a generally cylindrical shape with at least a partially corrugated side wall, a gas outlet, an outlet filter, a gas inlet and an inlet filter; sealing the container excepting the gas inlet and outlet; heating the container and its contents while feeding a gas through the gas inlet, inlet filter and dry precursor material; and collecting exhaust gas passing through the outlet filter and gas outlet; whereby a glass is produced in a form in which substantially all nitrate components have been decomposed and removed.

33. A method according to claim 32 wherein the gas is an inert gas.

* * * * *